United States Patent [19]

Provenzano, Jr.

[11] Patent Number: 4,582,317

[45] Date of Patent: Apr. 15, 1986

[54] MOVING HAND AMUSEMENT AND NOVELTY DEVICE

[75] Inventor: Victor Provenzano, Jr., Sepulveda, Calif.

[73] Assignee: Vic's Novelty, Inc., North Hollywood, Calif.

[21] Appl. No.: 580,866

[22] Filed: Feb. 16, 1984

[51] Int. Cl.[4] ..... A63J 3/00; A63J 23/00

[52] U.S. Cl. ..... 272/8 N; 446/390; 272/27 N

[58] Field of Search ..... 446/268, 298, 330, 352, 446/353, 354, 358, 390, 484, 198; 272/8 N, 8 R, 27 N; 3/12.7, 12.6, 12, 1.1

[56] References Cited

U.S. PATENT DOCUMENTS

| | | | |
|---|---|---|---|
| 2,733,545 | 2/1956 | Guadagna | 446/330 |
| 3,423,765 | 1/1969 | Salisbury, Jr. | 3/12.7 X |
| 4,259,806 | 4/1981 | Troll | 446/198 |

*Primary Examiner*—Mickey Yu

*Attorney, Agent, or Firm*—Rapkin, Gitlin & Moser

[57] ABSTRACT

An amusement and novelty device including a simulated human hand that vibrates and moves concurrently to give it a lifelike appearance. The hand is substantially hollow and contains a motor and a shaft rotatably connected thereto with a plurality of disc-shaped plates eccentrically mounted upon the shaft, which projects into the cavity of the hand to terminate within the recess defined by one of the fingers. The motor is secured and held substantially fixed within a motor mount, which is formed by reversing and then tucking in excess material that is attached to the rear of a wrist and then causing it to overlap and coincide with the walls of the cavity defined by the wrist to fit tightly around the motor. Activation of the motor rotates the shaft which then causes the finger to revolve either clockwise or counterclockwise, depending upon the preference of the user. The hand will move to the right when the finger revolves clockwise and to the left when the finger revolves counterclockwise.

8 Claims, 4 Drawing Figures

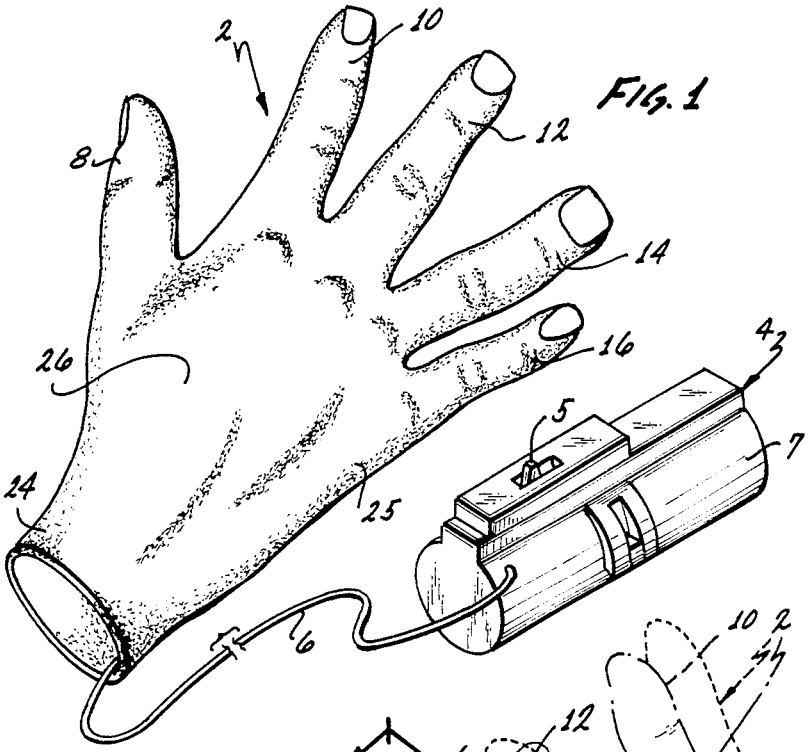
FIG. 1
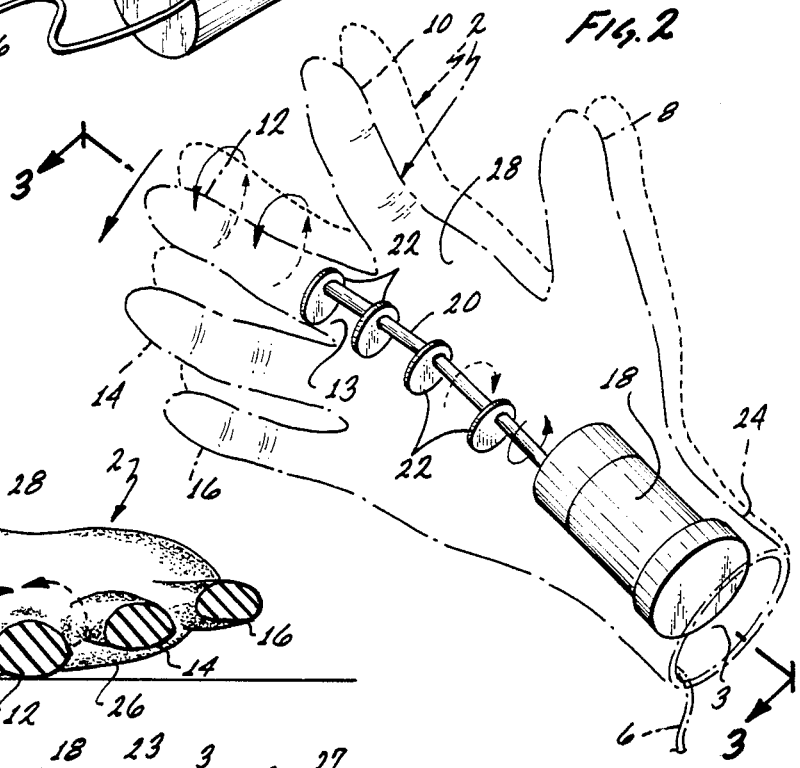
FIG. 2
FIG. 4
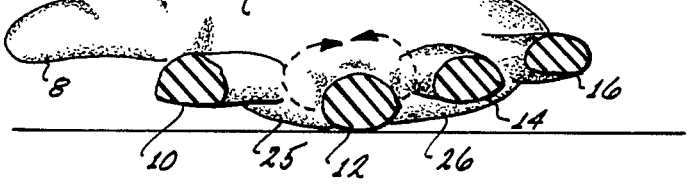
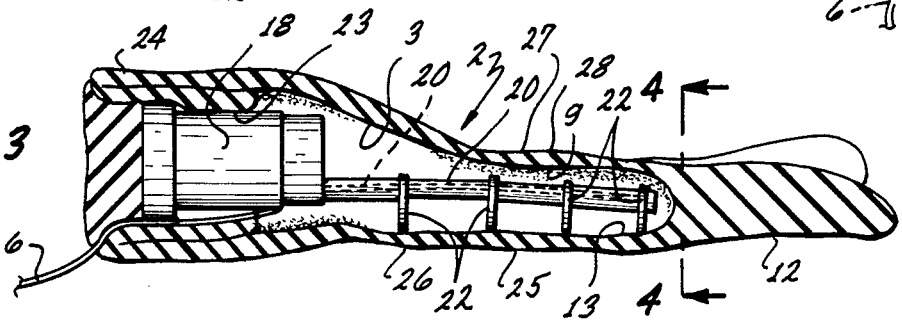
FIG. 3

MOVING HAND AMUSEMENT AND NOVELTY DEVICE

BACKGROUND OF THE INVENTION

1. Field of the Invention

The present invention relates to an amusement and novelty device and, more particularly, to a simulated human hand that vibrates and moves simultaneously to give it a virtual lifelike appearance.

2. Description of the Prior Art

The prior art discloses many kinds of novelty and amusement devices, including some that involve some use or simulation of a part of the human anatomy, such as a hand or an internal organ, such as the heart. Examples of U.S. Patents which disclosed devices of the kind already mentioned include the following:

| U.S. PAT. NO.: | INVENTOR |
|---|---|
| 2,931,135 | A. M. Zalkind |
| 3,224,139 | G. Reuge |
| 3,252,242 | A. M. Zalkind |

Examples of U.S. Patents which disclose technology generally pertinent to the art of the present invention include the following:

| U.S. PAT. NO.: | INVENTOR |
|---|---|
| 3,363,623 | C. F. Atwell |
| 3,549,920 | Jon H. Tavel |
| 3,991,751 | Jessie O'Rourke |
| 4,149,530 | Quinn W. Gow |

Sculptures and models of the human anatomy or individual parts thereof, including the human hand, are already known to exist in the prior art. The field of novelty and amusement devices, including items that are especially popular at Halloween and costume parties, such as rubber or rubberlike masks, feet and hands, are also well known. However, nothing known before to the applicant contains the unique combination of elements that are found in the present invention and that very convincingly simulates the appearance, movements and overall realism of an actual human hand.

SUMMARY OF THE INVENTION

The present invention comprises a simulation of a human hand that is substantially hollow and contains a motor and a shaft rotatably connected thereto with a plurality of disc-shaped plates eccentrically mounted upon the shaft. The forward portion of the shaft, including at least one of the aforementioned discs, projects into the cavity of the hand to terminate within the recess defined by one of the fingers. Batteries may be used as a power source and are ordinarily connected to the motor by an electrical wire.

The motor is secured and held substantially fixed within a motor mount, which is formed by reversing and then tucking in excess material that is attached to the rear of the wrist and then causing it to overlap and coincide with the walls of the cavity defined by the wrist to fit tightly around the motor. Activation of the motor rotates the shaft which, in turn, causes the finger to revolve either clockwise or counterclockwise, depending upon the preference of the user. When the finger reaches the lowest point of its revolution and thus comes into contact with the supporting surface, such as a floor, table top or other appropriate surface, the entire hand then begins to move or "walk" in the same direction as the finger is revolving. Thus, if the finger revolves clockwise, the hand will move to the right. Conversely, if the finger revolves counterclockwise, the hand will move to the left. Occurring simultaneously with the motion of the hand are certain vibrations, associated simulated skin movements and movements of the other appendages which are caused by a combination of the motor activity and the action of the rotary shaft, particularly the eccentrically mounted discs striking at the interior surface of the hand.

The present invention has applications, for example, as a toy, a conversation piece to provide amusement and entertainment at a social gathering, or as a promotional medium to aid in the marketing of such products as jewelry and certain types of clothing.

It is therefore a primary object of the present invention to provide a novelty and amusement device that simulates the appearance, movements, and overall realism of the human hand.

Another object of the present invention is to provide a simulated human hand which is more efficient in operation than prior art devices in that it imparts to the hand a more realistic appearance and movement.

Still another object of the present invention is to provide an amusement and novelty device which is simple and economical to manufacture and use.

Various other objects, features and attendant advantages of the present invention will be more fully appreciated as the same becomes better understood from the following detailed description of the present invention when considered in connection with the accompanying drawings.

BRIEF DESCRIPTION OF THE DRAWINGS

FIG. 1 is a perspective view of the preferred embodiment of the present invention.

FIG. 2 is a sectional view of the preferred embodiment of the hand of the present invention shown on FIG. 1 indicating one direction of movement when the invention is operational.

FIG. 3 is a sectional view of the same taken along line 3—3 of FIG. 2.

FIG. 4 is a partial sectional view of the same taken along line 4—4 of FIG. 3.

DETAILED DESCRIPTION OF THE PREFERRED EMBODIMENT

Referring to the drawings in FIGS. 1–4, a preferred embodiment of the present invention is shown comprising a human hand 2 molded of a suitable synthetic or natural material, such as rubber or a deformable resilient plastic, wherein the upper hand 26 simulates the back of a hand, including the backside of thumb 8, and fingers 10, 12, 14 and 16, and the lower hand 28 simulates the palm of a hand, including also the underside of thumb 8, and fingers 10, 12, 14 and 16. Hand 2 is essentially a hollow or shell-like structure having a cavity 3 to accommodate a motor 18 of any suitable conventional design. Motor 18 is secured and held tightly within motor mount 23 to ensure a predictable alignment of the rotary shaft 20 and movement of the hand 2. Motor mount 23 is formed by tucking inside the cavity defined by wrist 24 excess material that extends from the end of wrist 24. The overlap of the tucked material creates a sleeve that fits snugly around the casing of the motor 18 thereby rendering it almost immovable. Motor 18 drives a flexible rotary shaft 20 which projects axially through cavity 3 into recess 13. Eccentrically mounted upon shaft 20 are spaced discs 22. Motor 18 may be powered by any suitable source of energy, such as electrical in the form of batteries which are contained in housing 7 that is connected to motor 18 by wire 6. Switch 5 activates motor 18 by closing the electrical circuit between motor 18 and the power source.

In the operation of the present invention, hand 2 is placed on any suitable surface of a type that would maximize the amount of friction or resistance created by the contact of the hand 2 with the surface. For example, a carpet would be more suitable for use with the present invention than a slick surfaced linoleum or finished hard wood. The operator then holds the controls 4 and, depending upon whether the operator desires the hand 2 to more generally in a clockwise or counterclockwise direction, engages the switch 4 either forwards or backwards. In one example of the operation of the invention, when switch 5 is engaged in the forward position, the motor 18 is activated to drive concurrently the rotatably connected shaft 20 and the eccentrically mounted discs 22 in a clockwise direction. As shown in FIG. 2, during each revolution of the shaft 20, discs 22 will strike at various locations along the interior surfaces 9 and 11 and impart a revolving motion to finger 12 to give the hand the appearance of realism. At the lowest point of each revolution as shown in FIGS. 2–4, the finger 12 will engage the surface to elevate or drive the hand 2 upwards and move it in a generally sidewards direction. Thus, if the shaft 20 is rotated clockwise, then the finger 12 will revolve clockwise and the hand 2 will move in a direction generally to the right. Conversely, if the shaft 20 is rotated counterclockwise, then the finger 12 will revolve counterclockwise and the hand 2 will move in a direction generally to the left. The motor 18 also provides a vibrating effect which compounds the realistic appearance and movement of the hand 2 when combined with the motion created by the cooperating efforts of the rotating shaft 20 and discs 22.

The present invention has a variety of useful applications, for example, as an amusement device at a social gathering, such as a costume party; as a very novel action model for exhibiting jewelry or gloves; and as a special effect for use in the movies or on television. The present invention is also useful as a magician's gimmick. It may be used, for example, to count coins or cards or for directing or even misdirecting the audience's attention to or from some object or thing to achieve a successful trick. The shaft 20, within certain limitations, may also be bent into a variety of positions to create different kinds of effects, such as hand waving or a gesture of acknowledgment. When used for any of the foregoing applications, it should be understood that the present invention can be oriented vertically and supported by wrist 24, or a sleeve (not shown), horizontally either resting on the upper surface 25 or lower surface 27, or in a variety of other possible positions as required or desired.

Obviously, numerous modifications and variations of the present invention are possible in light of the above teachings. It is therefore to be understood that within the scope of the appended claims, the invention may be practiced otherwise than as specifically described herein.

What is claimed is:

1. An amusement device comprising a simulated hand, including an outer surface and an inner wall; a motor enclosed within said hand; a source of power; a bent shaft rotatably connected to and driven by said motor; means mounted upon said shaft and activated thereby to engage said inner wall when said shaft is activated by said motor to impart movement to said hand.

2. The invention of claim 1 wherein said hand is substantially hollow and includes a simulated substantially hollow wrist formed therewith, said wrist including an inner wall.

3. The invention of claim 2 wherein said means mounted upon said shaft and activated thereby comprises a plurality of disc-shaped plates eccentrically mounted upon said shaft.

4. The invention of claim 3 wherein said shaft and at least one of said eccentrically mounted discs extend from said motor into operative engagement with said inner wall defining one of the fingers of said hand whereby upon actuation of said motor said shaft and said disc thereon engage said inner wall of said finger to rotate said finger such that each revolution produces movement of said hand.

5. The invention of claim 4 wherein said power source is electrical.

6. The invention of claim 5 wherein said electrical power source is housed within an elongated handle connected to said motor which receives said electrical power from said source to rotate said shaft.

7. The invention of claim 6 wherein said motor is secured within a means to mount said motor.

8. The invention of claim 7 wherein said means to mount said motor comprises residual material formed from said wrist and said inner wall of said wrist, whereby said material is tucked inside said hollow wrist to overlap a substantial portion of said inner wall to create a sleeve to fit around and serve said motor within said hand.

* * * * *